US005727952A

United States Patent [19]

Schenck et al.

[11] Patent Number: 5,727,952

[45] Date of Patent: Mar. 17, 1998

[54] EDGE-ENCAPSULATED WRITING BOARD

[75] Inventors: Robert Schenck, Manitowoc; Jeff H. Hoffman, Two Rivers; Michael N. Klein, Sheboygan, all of Wis.

[73] Assignee: Classic Modular Systems, Inc., Two Rivers, Wis.

[21] Appl. No.: 684,225

[22] Filed: Jul. 19, 1996

[51] Int. Cl.[6] ..... B43L 1/06

[52] U.S. Cl. ..... 434/408; 434/415

[58] Field of Search ..... 434/408, 415, 434/416, 417, 421, 425, 422, 430

[56] References Cited

U.S. PATENT DOCUMENTS

| | | | |
|---|---|---|---|
| 23,343 | 3/1859 | Beebe . | |
| 33,144 | 8/1861 | Harper . | |
| 113,678 | 4/1871 | Lugenbell . | |
| 1,026,809 | 5/1912 | Kraus | 434/416 |
| 2,300,248 | 10/1942 | Elnett | 434/421 |
| 2,881,538 | 4/1959 | Lewis . | |
| 2,951,299 | 9/1960 | Fisco . | |
| 3,043,023 | 7/1962 | Colpo | 434/417 |
| 3,107,442 | 10/1963 | Levine | 434/417 |
| 3,363,341 | 1/1968 | Glassman | 434/417 |
| 3,432,944 | 3/1969 | Ishida | 434/417 |
| 3,846,011 | 11/1974 | Stein | 434/425 |
| 4,123,590 | 10/1978 | Hasegawa et al. | 434/425 |
| 4,487,586 | 12/1984 | Palmans | 434/408 |
| 4,584,223 | 4/1986 | Krapf | 434/430 |
| 4,828,502 | 5/1989 | Leahy | 434/416 |
| 5,035,626 | 7/1991 | Persing | 434/408 |
| 5,163,845 | 11/1992 | Blassingame | 434/408 |
| 5,176,522 | 1/1993 | Robertson, Jr. | 434/415 |
| 5,263,866 | 11/1993 | Campbell | 434/408 |
| 5,422,155 | 6/1995 | Spence, Jr. | 434/425 |

*Primary Examiner*—Paul J. Hirsch
*Attorney, Agent, or Firm*—Godfrey & Kahn, S.C.

[57] ABSTRACT

A dry marker board including a sheet of material having a writing surface upon which felt tip, erasable ink markers may be used. Preferably, the writing sheet is a sheet of ceramic-on-steel material. A shelf support, preferably made of wood, is mounted on the bottom portion of the writing sheet by fasteners such as nails or screws. Polyurethane is injection molded around the peripheral edge of the writing sheet, encapsulating the peripheral edge and sides of the writing sheet and the shelf support to form a unitary frame with a shelf.

8 Claims, 1 Drawing Sheet

EDGE-ENCAPSULATED WRITING BOARD

BACKGROUND OF THE INVENTION

The present invention relates to writing and display devices. More particularly, the present invention relates to a dry or erasable marker board of improved construction.

Devices such as chalkboards are used in various situations to write and display information. These devices include a writing sheet, such as slate, which is framed by wood or metal in order to strengthen and protect the writing sheet. In many instances, chalkboards have been replaced by boards upon which felt tip and, in particular, dry markers can be used. These boards have writing sheets specifically designed for use with such markers. Dry markers are filled with an erasable ink, making writing or other indicia placed on the boards easily erasable. Dry marker boards have several advantages over chalkboards including reduced weight and the elimination of chalkdust.

Various dry marker boards have been developed including the one shown in U.S. Pat. No. 5,176,522, issued to Robertson, Jr. Robertson, Jr. discloses a dry marker board having a rigid frame encompassing a planar marking surface. The frame includes an elongated top piece and a bottom piece, two side pieces, and corner joining elements.

While suitable in some instances, a dry marker or other writing board having a multi-component frame, such as the one disclosed by Robertson, Jr. is not suitable for all applications. Generally, multi-component frames have weak points at the joints of their components. In addition, the joining of the components can make manufacturing these types of writing boards difficult and expensive.

There have been attempts to create a writing board without a multi-component frame and, specifically, writing boards that have a writing surface which is integral with its frame. One such device is disclosed in U.S. Pat. No. 2,881,538, issued to Lewis. Lewis discloses a bulletin and writing board where the frame and writing surface are formed of the same material, integral with one another.

Despite attempts to create improved writing boards, there is a need for an improved dry marker board that includes a writing surface upon which erasable dry markers may be used and a frame which provides adequate strength and protection for the board. It would be desirable if the frame for such a dry marker board could be formed around a writing sheet as a unitary piece, thereby eliminating the need for a multi-component frame and the associated costs and difficulties of assembling same. Such a frame would also provide a good seal around the edge of multiple-layer writing sheets, such as ceramic-on-steel materials, which are used in writing boards. In addition, such a frame would be more securely fixed to the writing board than multi-component frames are, because the latter are attached to writing sheets by frictional means such as crimps, screws, and other fasteners.

OBJECTS AND SUMMARY OF THE INVENTION

Therefore, it is an object of the present invention to provide a dry marker board suitable for use with existing felt tip, erasable ink markers.

A further object of the present invention is to provide a dry marker board including a writing sheet with a unitary frame formed around its peripheral edge.

A further object of the present invention is to provide a dry marker board where the frame for the writing sheet is formed by encapsulating the edge of the writing sheet in polyurethane.

These and other objects and advantages are achieved in a dry marker board including a sheet of material having a writing surface upon which felt tip, erasable ink markers may be used. The writing surface has a top portion and a bottom portion. The writing sheet has a peripheral edge, a top side, a bottom side, a left side, and a right side. A shelf support, preferably made of wood, is mounted on the bottom portion of the writing sheet by fasteners such as nails or screws.

In order to form a frame for the writing sheet, an edge molding of polyurethane is applied on the peripheral edge of the writing sheet along its top, bottom, left, and right sides. The molding encapsulates the peripheral edge and sides of the writing sheet and the shelf support.

Further objects and advantages of the present invention will become more apparent from the following detailed description of the invention taken in combination with the accompanying drawings.

DETAILED DESCRIPTION OF THE INVENTION

Figure 1:
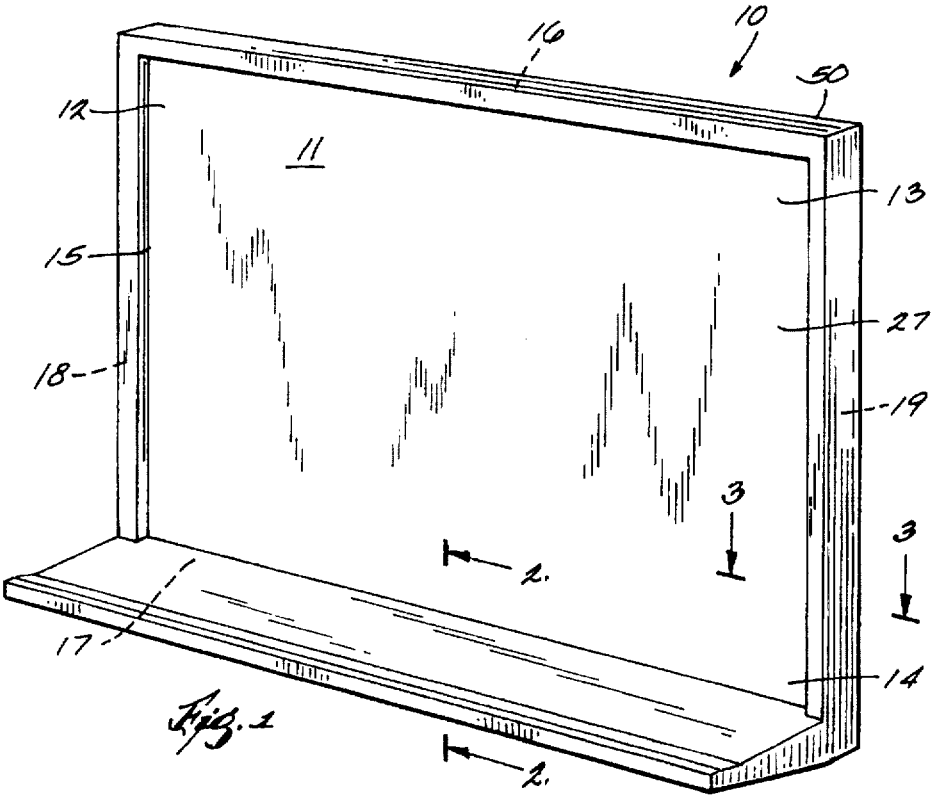
FIG. 1 is a perspective, right side view of a dry marker board made in accordance with the teachings of the present invention.

FIG. 1 shows a dry marker board 10 which is made in accordance with the teachings of the present invention. The marker board 10 includes a writing sheet 11 having a writing surface 12 upon which felt tip, erasable ink markers may be used. The writing sheet has a top portion 13, a bottom portion 14, a peripheral edge 15, a top side 16, a bottom side 17, a left side 18, and a right side 19.

Figure 2:
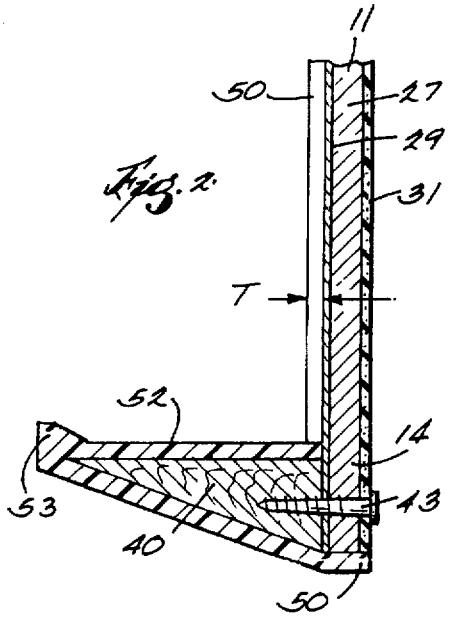
FIG. 2 is a partial, cross-sectional view of the dry marker board shown in FIG. 1 taken along the line 2—2.
Figure 3:
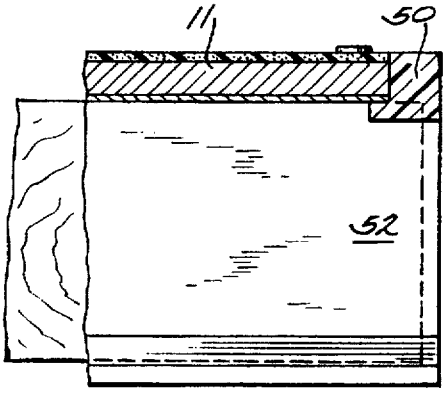
FIG. 3 is a partial, cross-sectional view of the dry marker board shown in FIG. 1 taken along the line 3—3.

Preferably, the writing sheet 11 is a sheet of ceramic-on-steel material and, more specifically, a porcelain enameled board with a 7/16" thick composite core with a mylar foil and appropriate adhesive (FIG. 2). Preferably, the writing sheet 11 has a thickness of about 0.5". Its height and width dimensions will vary according to the application at hand.

As can be seen from the drawings, the writing sheet 11 is constructed from multiple layers of material. The sheet of ceramic-on-steel material, writing sheet 11, includes a sheet of steel 27, a layer of porcelain 29 applied to one surface of the sheet of steel 27, and a layer of foam 31 applied to the other, opposite surface. The use of ceramic-on-steel material as a writing surface is known in the art and such sheets are available through various commercial suppliers.

Attached to the bottom portion 14 of the writing surface 11 is a shelf core or support 40. The shelf support 40 is mounted to the writing sheet 11 by means of fasteners 43, only one of which is shown. The fasteners 43 may be screws, nails, or similar fasteners. In a preferred embodiment, the shelf is triangularly shaped in cross section, made of wood, and has a length along its longest leg of about 3.0". The height of its other leg is about 1.0", although here again the dimensions and materials may vary with the particular application.

A frame 50 is formed around the peripheral edge 14, and the top, bottom, left, and right sides 16, 17, 18, and 19 of the writing sheet 11 by injection molding polyurethane, which is a polymeric material such as polyurethane, around its edges. A polymeric material, again preferably polyurethane is also molded around the shelf support 40 to form a shelf 52 having a lip 53. Thus, a unitary frame having a shelf is formed around the writing sheet 11. Preferably, the polymeric material should be a cast polyurethane elastomer having a hardness or durometer rating of 85, as measured on the Shore A scale. The polyurethane should be applied so that it has a final thickness "T" (FIG. 2) of at least about 0.1875". Polyurethane resin suitable for use in the present invention may be obtained from a variety of commercial suppliers that supply custom polyurethanes.

Constructing the writing or marker board 10 takes several steps. In the first step, a sheet of ceramic-on-steel material for the writing sheet 11 is selected according to the size of marker board desired. The shelf support is then fastened to the writing sheet 11 by a plurality of 1¼" funnel head screws or other fasteners. The writing sheet is then placed in a mold box. The mold box includes a wood frame, a mold cover, and an inner polyurethane, flexible mold having one or more injection holes. The mold is prepared with a commercially available mold release such as a silicone wax. The writing sheet is centered in place and the mold cover is closed in order to seal the writing sheet in the mold box. The mold is filled by injecting polyurethane through the injection hole (s). After about a one minute cure time, the mold cover is opened and the finished part is extracted from the mold.

While the present invention has been described in what is believed to be the most preferred form, it is to be understood that the invention is not confined to the particular construction and arrangement of the components herein illustrated and described, but embraces such modified forms thereof as come within the scope of the appended claims. In particular, it should be understood that a polyurethane frame may be molded around a variety of materials other than ceramic-on-steel writing sheets.

What is claimed is:

1. A writing board comprising:

a writing sheet having a peripheral edge, a top portion, and a bottom portion;

an edge molding of polymeric material molded on the peripheral edge of the writing sheet, encapsulating the peripheral edge of the writing sheet to form a single-piece frame around the writing sheet; and a shelf core mounted on the bottom portion of the writing sheet, wherein the edge molding of polymeric material encapsulates the peripheral edge of the writing sheet and the shelf core to form said single-piece frame around the writing sheet and a shelf, which is integral with the frame, on the shelf core.

2. A writing board as claimed in claim 1, wherein the polymeric material is polyurethane.

3. A writing board as claimed in claim 1, wherein the writing sheet is a sheet of ceramic-on-steel material.

4. A writing board as claimed in claim 1, wherein the shelf core is a made from wood.

5. A writing board as claimed in claim 1, wherein the shelf core is mounted to the writing sheet by screws.

6. A writing board suitable for use with felt tip, erasable ink markers, the writing board comprising:

a writing sheet of ceramic-on-steel material having a peripheral edge, a top side, a bottom side, a left side, and a right side;

a shelf core mounted near the bottom side of the writing sheet; and an edge molding of polyurethane molded on the peripheral edge of the writing sheet, encapsulating the peripheral edge of the writing sheet, its top, bottom, left, and right sides, and the shelf core and forming a single-piece frame around the writing sheet.

7. A writing board as claimed in claim 6, wherein the shelf core is a made from wood.

8. A writing board as claimed in claim 6, wherein the shelf core is mounted to the writing sheet by screws.

* * * * *